United States Patent [19]

Schweitzer

[11] 4,092,922

[45] June 6, 1978

[54] LITHOGRAPHIC INK SUPPLY

[75] Inventor: Roy C. Schweitzer, Barrington, Ill.

[73] Assignee: Addressograph-Multigraph Corporation, Cleveland, Ohio

[21] Appl. No.: 765,059

[22] Filed: Feb. 2, 1977

Related U.S. Application Data

[63] Continuation-in-part of Ser. No. 599,158, Jul. 25, 1975 abandoned.

[51] Int. Cl.[2] ..... B41L 25/12

[52] U.S. Cl. ..... 101/363; 101/364

[58] Field of Search ..... 101/366, 349, 350, 363, 101/364, 148, 207–210; 118/7, 259; 222/325, 353, 586, 352, 437, 457, 479

[56] References Cited

U.S. PATENT DOCUMENTS

| | | | |
|---|---|---|---|
| 2,096,385 | 10/1937 | Slater | 101/351 |
| 2,177,772 | 10/1939 | Gregory | 222/586 |
| 2,748,698 | 6/1956 | Hanson et al. | 101/350 |
| 3,070,825 | 1/1963 | Martin | 101/363 X |
| 3,094,924 | 6/1963 | Stark | 101/364 |
| 3,145,653 | 8/1964 | Lake | 101/364 |
| 3,316,839 | 5/1967 | Lake | 101/364 |
| 3,318,238 | 5/1967 | Gottsche | 101/363 |
| 3,556,008 | 1/1971 | Branfield | 101/350 |
| 3,631,800 | 1/1972 | Mignone | 101/350 |
| 3,645,202 | 2/1972 | Lake | 101/148 |

*Primary Examiner*—J. Reed Fisher
*Attorney, Agent, or Firm*—Sol L. Goldstein

[57] ABSTRACT

An ink package comprising a disposable container is provided for supplying ink to an ink fountain of a lithographic duplicating machine and includes a self-contained, sealed package provided with specially configured nozzle means for dispensing ink from the container directly into an ink fountain. The ink used in the container is designed to be within the higher ranges of flowability for lithographic ink, and hence, due to special design of the nozzle aperture or apertures, is able to flow sluggishly from the container by gravity, whenever the nozzle means is exposed to the atmosphere, to spread longitudinally of the fountain roller, and to form an elongate bead of ink which increases in size until it blocks exposure of the nozzle means to the atmosphere and thereby shuts off flow from the nozzle means. Thus, a substantially constant volume of ink is maintained in the ink fountain as long as any ink remains in the container.

1 Claim, 3 Drawing Figures

LITHOGRAPHIC INK SUPPLY

CROSS REFERENCE

This application is a continuation-in-part of my copending application, Ser. No. 599,158, now abandoned filed July 25, 1975.

BACKGROUND OF THE INVENTION

Among the wide variety of ink fountains on lithographic duplicating machines in use today, it is customary practice to supply the ink in the fountain by transferring the ink from a can, tube, or the like to the ink fountain of the machine. This manner of transferring the ink from the container to the fountain is usually effected manually and, therefore, oftentimes results in the operator's having ink-soiled fingers and clothing.

Additionally, because the ink in the fountain is exposed to the atmosphere, it is exposed to dust, dirt, lint and other foreign matter in the air which settles on the surface of the ink. As will be appreciated, this foreign matter in the ink fountain is likely to be passed through the ink train and onto the printing plate and often creates problems in attempting to obtain high quality duplicated copies.

Over the years, various attempts have been made to provide an ink package capable of preventing soiling of the hands during replenishment of ink in the ink fountains of lithographic duplicators and to prevent contamination of the ink.

One such device is shown in U.S. Pat. No. 3,561,360 and comprises a container removably mounted in an ink fountain and adapted to contain a supply of ink for application to an inking roller. One wall of the container is provided with outlet openings, and the container is adapted to cooperate with pressure applying means to expel the ink from the container via outlet openings onto the inking roller. The pressure applying means comprises a pusher continuously urged against a plunger by spring means to cause ink to be expelled from the container. The spring means is wound manually and, as it unwinds during operation, the plunger continues to force ink out of the container onto the inking roller.

Although the foregoing device provides a disposable ink container for maintaining the ink and the fountain substantially free from contamination, it does not provide for supplying and maintaining a substantially constant volume of ink on the inking roller by initiating and terminating the flow of ink from the container in response to the volume of ink on the inking roller as in the present invention.

Rather, the foregoing device relies merely on the urging of the spring means for continuously forcing the ink from the container without starting and stopping the flow of ink so as to maintain a uniform supply of ink on the inking roller as determined by the rate at which the ink is used in the duplicating operation. Hence, depending upon the amount and the rate at which the ink on the inking roller is utilized such a device, with provisions for only expelling and not stopping ink flow from the container, could well result in an oversupply of ink on the inking roller. Additionally, the various mechanisms and component parts required to dispense the ink from the container add considerably to the cost of the container and to the ink fountain designed to accept and coact with such a container.

SUMMARY OF THE INVENTION

The present invention provides an extremely simple construction in which an ink package comprising a disposable container supplies lithographic ink to an ink fountain roller of a lithographic duplicating machine. The package provides a self-contained, sealed device to prevent contamination of the ink within itself, and so overlies the ink fountain as to protect the ink in the fountain as well, and includes nozzle means for dispensing the ink by gravity from the shipping and storage container directly to the fountain roller.

By far the largest amount of ink used in lithographic duplicators has a stiffness and viscosity such that its flowability is negligible, so that special means for transfer of ink from a storage situation to an ink fountain have been regarded by the art as essential.

The ink used in the container of the present invention, however, is designed to be within the higher ranges of flowability for lithographic ink, and is thus able to flow, albeit rather sluggishly, from the container so long as the nozzle means is exposed to the atmosphere. The ink dispensed from the container forms an ink bead at the fountain roller which increases in size until it blocks exposure of the nozzle means to the atmosphere and shuts off the flow from the nozzle means.

During a duplicating operation, each time the volume of the ink bead is diminished to a level such that the nozzle means is partially exposed to the atmosphere, there is created an air passage allowing an air bubble to enter the interior of the container, and the air bubble initiates a further increment of flow of ink from the container. This operation of starting and stopping the flow of ink continues so as to maintain a substantially constant volume of ink at the fountain roller so long as any ink remains in the container.

While the use of a somewhat similar level control principle of the barometric type using containers, free of openings except for the dispensing means and made up of nondeflectable, nonshiftable elements is well-known for use with readily flowing liquids, so far as I am aware, the art has never realized the possibility of its use for controlling the flow of lithographic inks which, at their least viscous, still flow only very sluggishly.

It is an object of the present invention to provide an ink package comprising a disposable container for use with a lithographic duplicating machine which maintains the ink in the ink fountain as well as the ink in the reserve supply, free from contamination.

Another object is to provide an ink package including a container for dispensing lithographic ink by gravity, and for barometrically starting and stopping the flow of ink as determined by the rate at which the ink is being used in the duplicating operation to thereby maintain a substantially constant volume of ink at the fountain roller.

Another object is to provide an ink package and disposable container for dispensing an ink designed to be within the higher ranges of flowability for lithographic ink, such that the ink flows sluggishly by gravity from the container to form a bead of ink at the fountain roller without the aid of pressing or squeezing means for forcing the ink from the container.

Another object of the invention is to provide a container which, without mechanical assistance, will dispense lithographic ink in an elongate bead formation directly to the fountain roller of a lithographic duplicator.

A feature of the invention is to provide an inexpensive lithographic ink package comprising a disposable container which, when the ink in the container is exhausted, can be readily replaced by a casual operator without serious inconvenience, and with minimum chance for the soiling of hands in the process.

Other objects, features and advantages of the invention will appear hereinafter as the description proceeds.

IN THE DRAWING

FIG. 1 is a bottom plan view of an ink package in accordance with the present invention;

FIG. 2 is a section taken on the line 2—2 of FIG. 1, but also shows cover strips for sealing the package nozzles during shipment and storage; this view further illustrates in phantom the relative position which the fountain roller will occupy when the container is placed in the support associated with the ink fountain; and FIG. 3 is a section taken on the line 3—3 of FIG. 1 with respect to the ink package itself, but also shows the ink fountain and package support in operative relation to the ink package, and a bead of ink being dispensed from the package onto a metering blade associated with a fountain roller.

DESCRIPTION OF THE PREFERRED EMBODIMENT

Figure 1:
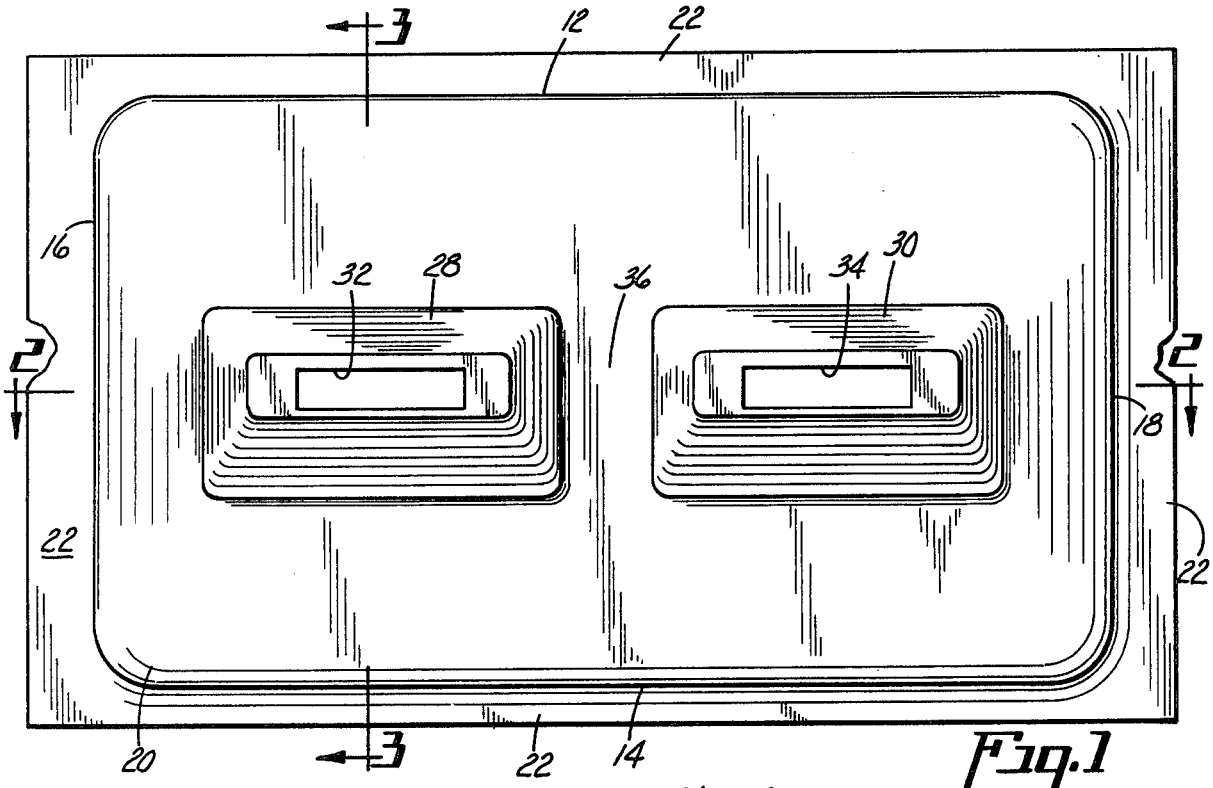

An ink package comprising a disposable container is indicated generally by the reference character 10 and provides a container of elongate configuration having an integral container body whose length is generally commensurate with the length of the ink fountain and roller, and comprising peripheral side walls 12 and 14, end walls 16 and 18, and a bottom 20. The upper margins of the side and the end walls are formed outwardly from the body to provide a support flange 22 extending completely around the periphery of the body. A cover 24 encloses the top of the container 10, and the margins of the cover 24 are sealed to the support flange 22 to provide a tightly sealed container to prevent exposure and contamination of ink 26 in the container 10.

Figure 2:
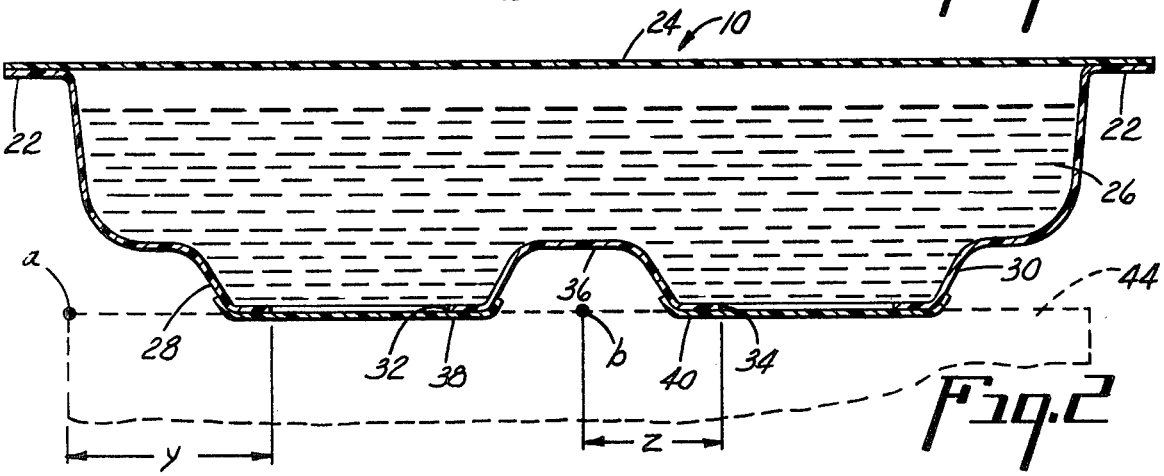

The lower portions of the side walls 12 and 14 and the end walls 16 and 18 terminate in a curved surface which blends smoothly into the bottom 20. The bottom 20 is so shaped as to define a pair of depending nozzle means 28 and 30 each including an elongate opening defining a dispensing slot which slots are numbered 32 and 34 respectively. Although the embodiment illustrated includes a pair of elongate nozzle means 28 and 30, with their major axes in alignment and spaced from each other by an arched section 36 of the bottom 20, it is to be understood that any nozzle array including a single nozzle means only or more than two nozzles could be provided and still produce the desired results of the present invention. When plural nozzle slots are used they are disposed in a somewhat linear arrangement. In order to operate successfully each of the dispensing slots, such as 32 and 34, provides an opening of at least ½ square inch (3.23 sq. cm.) of the surface area with no dimension of the slot being less than ⅜ inch (0.95 cm.). The dimension of any such opening in a direction transversely of the array should not exceed 1 inch, (2.54 cm.) and the total area of the openings in any array should not exceed a value whose number of area units is equal to one-half of the number of corresponding length units in the length of the fountain (e.g. for a 9-inch fountain, the total opening area should not exceed 4½ square inches). Whatever nozzle array is selected, either a single nozzle, or the plural nozzle array, its long dimension is so arranged as to extend parallel to the fountain roller axis when the container is in operating position on its support 50, hereinafter described, and the opening or openings are so arranged that no point on the fountain roller axis will be displaced from the closest limit of the nozzle opening nearest to such point by more than about 2 inches (5 cm.) measured axially of the roller. This relationship is best seen in FIG. 2 wherein the dotted line indicates the outline of the fountain roller, and the points "*a*" and "*b*" are seen to be at distances "*Y*" and "*z*" from the nearest nozzle limit. These distances are actually 1.7 inches (4.3 cm.) and 1.25 inches (3.17 cm.) respectively in the form shown, and should not exceed 2 inches (5 cm.) in any case in order to provide uniform distribution of ink lengthwise of the fountain roller. This arrangement allows the ink to distribute itself readily as an elongate bead extending lengthwise of the fountain roller so that all portions of the fountain are replenished in a substantially uniform manner. The foregoing nozzle parameters are required to permit adequately rapid flow of the lithographic ink and, at the same time, provide sufficiently uniform distribution of ink lenthwise of the fountain roller axis.

As shown in FIG. 2, when the package 10 is not in use the dispensing slots 32 and 34 are each sealed with a removable adhesive cover strip 38 and 40 respectively, to prevent leakage of ink from the container. Actual caps with snap-on or other mechanical types of connection would also be effective.

Because the container is adapted to be a disposable unit, it may, for example, be formed of any suitable substantially rigid material such as plastic material, strong card stock of a nature impermeable to ink, lightweight sheet metal, or a combination of such materials. Preferably, however, the body of the container 10 is molded from a suitable synthetic plastic material and the cover 20, made of the same material, is securely sealed thereto in an essentially nondeflectable manner as seen in the drawing, the completed container, with the cover 24 sealed to the flange 22 is free of access passages other than the dispensing opening means 32, 34.

In filling the container body 10 with a supply of ink 26, the strips 38 and 40 may be placed over the dispensing slots 32 and 34 to seal the slots against leakage of ink, the container then filled with ink via the top opening, and the cover 24 sealed to the support flap 22. Alternately, the cover 24 may be sealed to the container prior to filling the container with ink, the container then filled with ink through the dispensing slots 32 and 34 and the slots sealed with the cover strips 38 and 40.

Figure 3:
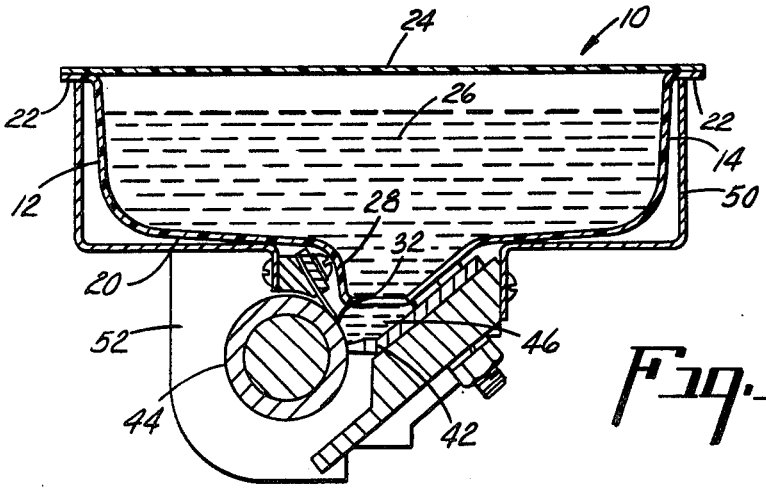

The package 10 is readily replaceable in a support means 50 mounted on the ink fountain 52 of a duplicating machine where it is supported by having its support flange 22 rest upon the upper portions of the walls of the support means, the latter acting as a housing generally enclosing the ink in the ink fountain. In an operative position for dispensing ink, the container 10 assumes a position as shown substantially in FIG. 3, wherein the lower tips of the nozzle means 28 and 30 are disposed at least about ¼ inch (0.635 cm.) and preferably not more than about ⅜ inch (0.95 cm.) above the ink support surface, in this case the surface of an ink metering blade 42 associated with an ink fountain roller 44. This arrangement allows for the lag due to sluggish ink flow and accordingly permits a bead of ink of sufficient size to occupy the fountain to reliably maintain operations between the occasions when the container delivers ink, and does not require any undue excess of ink to be present in the fountain outside of the container at any one time.

As long as any portion of either of the dispensing slots 32 and 34 is exposed to the atmosphere, and the supply of ink 26 is not exhausted, and ink flows from the container by gravity and forms a bead of ink 46 on the metering blade 42 and in contact with the fountain roller 44. However, as the bead of ink 46 increases in size, thereby blocking exposure of the dispensing slots 32 and 34 to the atmosphere, it shuts off flow of ink from the container.

As is customary in lithographic duplicating, the metering blade 42 in adjustable relative to the surface of the fountain roller 44 to control the amount of ink carried by the fountain roller. In turn, the fountain roller supplies ink to an ink train terminating at a form roller which applies the ink to a printing plate on a cylinder of the duplicating machine.

The construction and operation of the metering blade 42 is disclosed in U.S. application Ser. No. 607,238, filed Aug. 25, 1975, and the duplicating machine with which the ink supply container 10 of the present invention may be used is disclosed in copending U.S. application Ser. No. 599,700, filed June 26, 1975, both applications being assigned to the same assignee as the present invention.

The ink 26 with which the container 10 is used is specially designed to be within the higher ranges of flowability for lithographic ink, and hence is able to flow sluggishly from the container to form the ink bead 46. While flowability is not precisely related to the viscosity of the lithographic ink, the acceptable range of flowability can, as a practical matter, be adequately defined, for the purpose of this invention, in terms of this property. The inks usable in conncection with this invention have relatively high flowability which means that their viscosity is rather low as compared with the more commonly used lithographic inks. The usable inks may be defined as those whose viscosity at 70° F. (or about 21° C.) is not above 35,000 centipoises when tested at 21.6 RPM using a Haake cone and plate viscosimeter. As a practical matter to be usable in lithographic applications, ink will require a viscosity of at least about 15,000 centipoises when tested under circumstances where it has not been recently worked, and under the same conditions of temperature and viscosimeter velocity as stated above. For the purposes of this disclosure, then, the term "low viscosity lithographic ink" signifies ink falling within the range of viscosities specified hereinabove.

In the operation of the ink package 10, the cover strips 38 and 40 are removed to expose the dispensing slots 32 and 34 and the container is placed into the support means of the duplicating machine. This can be accomplished with no difficulty because the flow of ink is so sluggish that none will be released from the nozzles in the time required to turn the container over and drop it into place. As stated supra, so long as the dispensing slots 32 and 34 are exposed to the atmosphere to permit the entry of air into the interior of the container, prior to the build-up of the ink bead 46 to a size sufficient to block off the air supply to the container, the ink 26 will flow by gravity to form the ink bead 46. When the volume of the ink bead is sufficient to close the dispensing slots 32 and 34 to the atmosphere, it shuts off the flow of ink.

As the bead of ink 46 diminishes in size during the duplicating operation, the foregoing operation of starting and stopping the ink flow continues to thereby maintain a substantially constant volume of ink at the fountain roller. Thus, each minor depletion of the ink bead 46 creates an air passage to the interior of the container such that an air bubble entering the container, through the dispensing slots 32 and 34, works its way up through the supply of ink 26 to the top of the container. This entry of air into the container is sufficient to cause further flow of the ink until such time as the ink bead is again large enough to close off the air supply to the dispensing slots 32 and 34 and discontinue ink flow.

The package 10 continues to dispense the ink in quantities commensurate with the rate at which the ink is being used in the duplicating operation, without resort to mechanism for forcing the ink from the container, until such time as the supply of ink 26 in the container is exhausted. At such time, the empty package is readily removed from its support and replaced with a new container 10 containing a fresh supply of ink.

From the foregoing, it will be appreciated that the present invention provides an inexpensive, easy-to-use, sealed ink package and disposable container for use with a lithographic duplicating machine. The package effectively dispenses the lithographic ink as required to maintain a substantially constant volume of ink at the fountain roller, without the need for sensing means for detecting the amount of ink supply at the fountain roller or for actuating means for forcing the ink from the container. Also, the sealed package maintains the ink within itself free from contamination, and further overlies the ink fountain in such a manner as to provide, together with its support, substantial protection of the ink from contamination after it has been dispensed from the container into the fountain. It also affords clean-hand operation of the container by the machine operator during replenishment. All of the foregoing advantages are made available with the utmost mechanical simplicity and a total lack of additional operating parts on the machine.

What is claimed is:

1. A method of maintaining a substantially constant volume of ink on a fountain roller of a lithographic duplicating machine having an ink fountain including a fountain roller, and a support means above the fountain comprising the steps of:

(a) providing an ink package comprising a disposable container body containing a supply of operative lithographic low viscosity ink and including dispensing opening means to permit flow of ink when the dispensing opening means is exposed to the atmosphere, the dispensing opening means comprising a substantially linear opening array suited for disposition parallel to the fountain roller axis, the opening array including no opening smaller than one-half square inch in area or smaller than three-eighths inch in minimum dimension, and being so arranged as to present a portion of an opening within two inches measured axially from any portion of the fountain roller, a cover overlying the container body and sealed thereto, the container body and cover being made of nondeflectable, nonshiftable elements and being free of access passages other than said dispensing opening means, and readily removable closure means for sealing the dispensing opening means to prevent flow of ink during storage of the ink package;

(b) removing the closure means from the ink package and placing the ink package on the support means with the dispensing opening means facing downwardly and with the opening array parallel to the fountain roller axis and spaced above the ink support surfaces of the fountain by at least about one quarter inch such that the ink flows directly into the fountain and against the fountain roller forming an elongate bead of ink which increases in size until it blocks exposure of the dispensing opening means to the atmosphere and shuts off flow of ink from the container body;

(c) maintaining substantially constant the volume of the bead of ink by spontaneous replenishment in response to exposure of the dispensing opening means to the atmosphere as the volume of the bead of ink is diminished during duplicating operation;

(d) removing and discarding the ink package from the machine when the supply of ink in the container body is exhausted.

* * * * *